US005401335A

United States Patent [19]

Grell

[11] Patent Number: 5,401,335

[45] Date of Patent: Mar. 28, 1995

[54] PULSER RINGS

[75] Inventor: Karl-Ludwig Grell, Aurachtal, Germany

[73] Assignee: Ina Walzlager Schaeffler KG, Germany

[21] Appl. No.: 132,456

[22] Filed: Oct. 6, 1993

[30] Foreign Application Priority Data

Oct. 17, 1992 [DE] Germany ..... 42 35 115.4

[51] Int. Cl.[6] ..... C22C 38/18

[52] U.S. Cl. ..... 148/325

[58] Field of Search ..... 148/325; 420/34

[56] References Cited

U.S. PATENT DOCUMENTS 4,994,122 2/1991 DeBold et al. ..... 148/325

FOREIGN PATENT DOCUMENTS 57-41352 3/1982 Japan ..... 420/43

2051859 1/1981 United Kingdom ..... 420/43

*Primary Examiner*—Deborah Yee

*Attorney, Agent, or Firm*—Bierman and Muserlian

[57] ABSTRACT

A pulser ring made of a ferritic iron alloy with the following composition (in wt. %)

max. 0.12% C, max. 1.00% Si, max. 1.00% Mn, max. 0.045% P, max. 0.030% S and max. 18% Cr, with the rest being iron with impurities conditional upon the melting process and a method of heat treating the same.

3 Claims, 1 Drawing Sheet

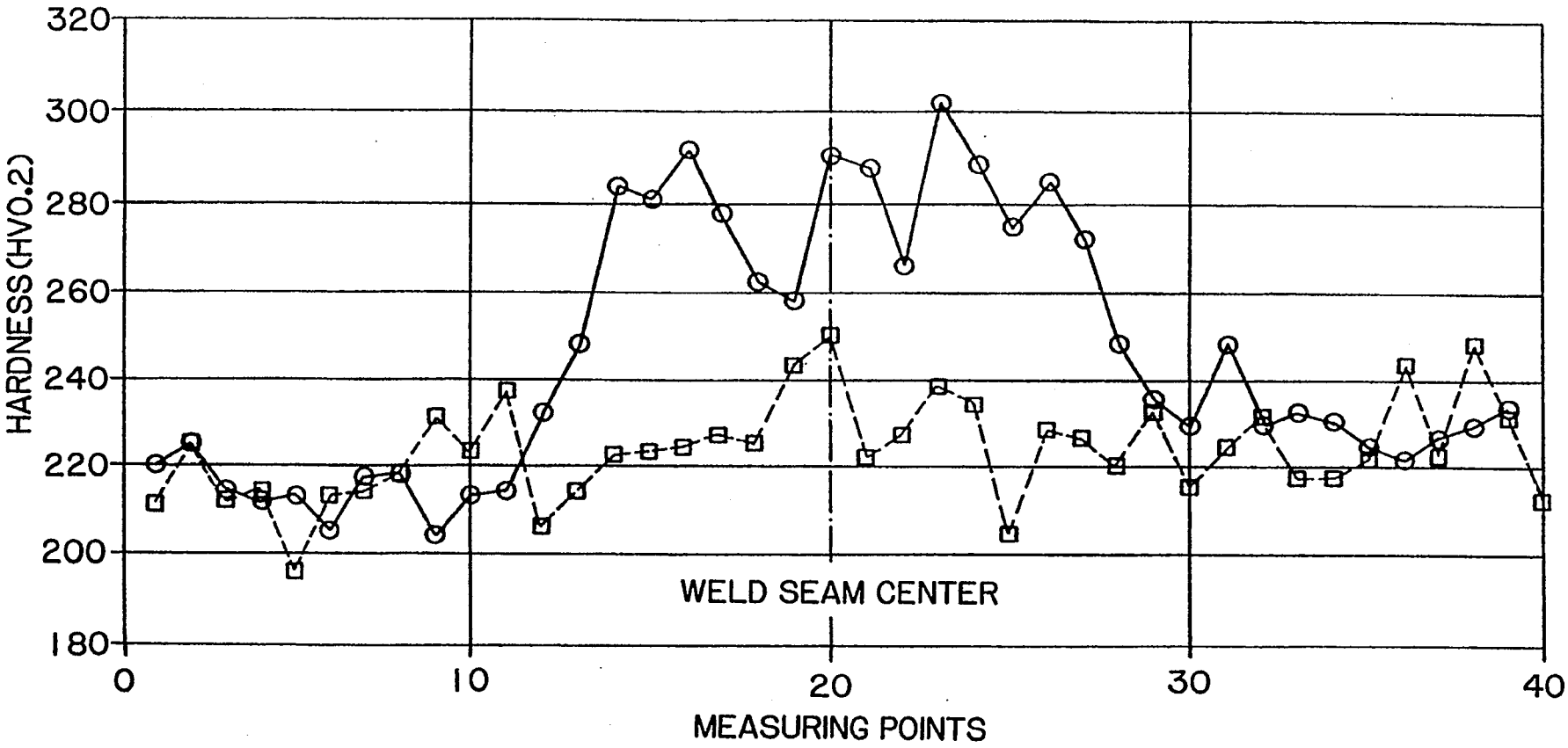
HARDNESS (HV0.2)
320
300
280
260
240
220
200
180
0
10
20
30
40
MEASURING POINTS
WELD SEAM CENTER

PULSER RINGS

STATE OF THE ART

Pulser rings are required, for example, in anti-locking brake systems of automotive vehicles and the pulser ring is mounted on the hub of a wheel. When the wheel is rotating, the pulser ring produces an alternating voltage in the inductive rotational sensing device, the frequency of the voltage produced being proportionate to the speed of the wheel. For corrosion protection, it is a common practice to make such pulser rings of a rust-proof ferromagnetic steel strip. At first, pulser pockets are punched out of the strip which is then rolled and resistance welded together at its ends. After deburring of the weld seam, the pulser rings are pressed onto the hub of the wheel with the requirement that the precision of spacing of the punched pockets necessary for the production of uniform pulses is not changed during the operation of pressing onto the hub.

In this connection, it is known to use a high alloy weldable material containing titanium or niobium and designated as X 6 CrTi 17. Pulser rings made or welded of this material show a fine grained microstructure in the weld seam. Since the presence of titanium causes the carbon contained in the material to be bound in the form of titanium carbide, no structural hardening takes place due to the lack of "free" carbon or iron chromium carbide precipitations. This means that the material in the weld seam of the pulser ring is softer than the rest of the material.

Due to the fact that the recrystallization temperature is exceeded during the welding also due to the already described want of hardening in the case of welding, there develops a wide soft region within the weld seam zone of the pulser ring. When the pulser ring is pressed onto the hub with the required force, plastifications occur, partly in the weld seam region, due to the low yield strength which lead to excessive spacing errors in this region of the pulser ring which cannot be subsequently corrected. Thus, the pockets adjacent to the weld seam undergo strong plastic overstretching while the rest of the pulser pockets are subjected to weak elastic deformations so that differing dimensions are encountered in the pulser ring which constitute spacing errors that lead to unusable pulse frequencies.

OBJECTS OF THE INVENTION

It is an object of the invention to provide a weldable ferritic iron alloy pulser ring with a high chromium content having at least the same hardness and yield strength in the weld seam region as in the rest of the material.

It is another object of the invention to anneal the pulser ring before mounting the same on the wheel.

These and other objects and advantages of the invention will become obvious from the following detailed description.

THE INVENTION

The novel pulser ring of the invention is made of a ferritic iron alloy with the following composition (in wt. %)

max. 0.12% C,
max. 1.00% Si,
max. 1.00% Mn,
max. 0.045% P,
max. 0.030% S and
max. 18% Cr, with the rest being iron with impurities conditional upon the melting process. Preferably, the pulser ring contains
0.02–0.12% C,
0.05–1.00% Si,
0.1–1.00% Mn,
0.001–0,045% P,
0.001–0.030% S and
8–18% Cr.

Because a binding of the transformable carbon content by the carbon-stabilizing elements titanium or niobium does not take place, the carbon present in the material is available in the ternary system Fe—Cr—C for the transformation of the microstructure. By this, a slight increase of hardness and yield strength as compared to the rest of the material is obtained in the weld seam. The ferritic fineness of grain in the so-called temperature transition range (recrystallization temperature range) is guaranteed by the short heating phase during welding because ferritic grain growth in the absence of stabilizing elements like titanium, although essentially dependent on the temperature level, is also time-dependent.

By this modification of properties in the weld seam region, plastifications, with their negative consequences for pulse generation are avoided i.e., no spacing errors occur and a firm interference fit of the pulser ring on the hub is obtained. If such an alloy is additionally annealed at 920° C. for about 30 minutes, a $\alpha$-matrix with chromium iron carbide precipitation is obtained which imparts a uniformly high strength and yield point to the microstructure of the weld seam region and the entire cross-section.

REFERRING TO THE FIG.

The FIGURE is a graph showing the curve obtained by plotting the hardness valves in the weld seam and adjacent area.

In the following example, there is described a preferred embodiment to illustrate the invention. However, it is to be understood that the invention is not intended to be limited to the specific embodiment.

EXAMPLE

Pulse pockets were punched out at regular intervals in a rust-proof ferromagnetic steel strip comprised of 0.10% by weight of carbon, 0.38% by weight of manganese, 0.002% by weight of sulfur and 17.2% by weight of chromium. The strip was then rolled together and resistance welded to form a pulser ring. The Figure shows a curve obtained by plotting the hardness values of the aforementioned alloy measured at several points in the weld seam region and in the adjacent region. The center of the weld seam is at measuring point 20 and the interval between measuring points is 0.1 mm. As can be seen from the curve in which the measuring points are represented as circles, by using the alloy of the invention, higher hardness is obtained in the weld seam than in the rest of the strip material.

While on both sides adjacent the weld seam, hardnesses in the range of approximately 210 to 220, and 220 and 230 kilopounds per square millimeter respectively were obtained, hardness values determined in the weld seam region were between 260 and 300 kilopounds per square millimeter. If, however, the alloy is subjected to a half-hour annealing at 920° C., the hardness peaks of the weld seam flatten and a more or less uniform curve in the range of 200 to 240 kilopounds per square millimeter is obtained over the entire cross-section.

Various modifications of the pulser ring of the invention may be made without departing from the spirit or scope thereof and it should be understood that the invention is intended to be limited only as defined in the appended claims.

What I claim is:

1. A pulser ring made of a ferritic iron alloy consisting of (in wt. %)

max. 0.12% C,
max. 1.00% Si,
max. 1.00% Mn,
max 0.045% P,
max. 0.030% S and
max. 18% Cr, with the rest being iron with impurities conditional upon the melting process, said ring having a weld seam zone without over-stretching of individual pockets and having the same hardness and yield strength as in the rest of the material.

2. A pulser ring of claim 1 wherein the ferritic iron alloy contains 0.02–0.12% C,
0.05–1.00% Si,
0.1–1.00% Mn,
0.001–0.045% P,
0.001–0.030% S and
8–18% Cr.

3. A pulser ring of claim 1 which has been annealed at about 920° C. for about 30 minutes.

* * * * *